US006484814B2

(12) United States Patent
Bongers-Ambrosius

(10) Patent No.: US 6,484,814 B2
(45) Date of Patent: Nov. 26, 2002

(54) ELECTRIC HAND TOOL IMPLEMENT WITH NO-LOAD STROKE DISCONNECTION

(75) Inventor: Hans-Werner Bongers-Ambrosius, München (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/900,542

(22) Filed: Jul. 6, 2001

(65) Prior Publication Data

US 2002/0003045 A1 Jan. 10, 2002

(30) Foreign Application Priority Data

Jul. 8, 2000 (DE) ..... 100 33 362

(51) Int. Cl.[7] ..... B25D 11/04

(52) U.S. Cl. ..... 173/2; 173/176; 173/179; 173/201

(58) Field of Search ..... 173/2, 4, 176, 173/179, 201, 47

(56) References Cited

U.S. PATENT DOCUMENTS

| | | | | | |
|---|---|---|---|---|---|
| 5,170,358 | A | * | 12/1992 | Delio | 173/2 |
| 5,435,397 | A | * | 7/1995 | Demuth | 173/201 |
| 5,775,440 | A | * | 7/1998 | Shinma | 173/201 |
| 5,975,217 | A | * | 11/1999 | Frenzel et al. | 173/201 |
| 6,044,918 | A | * | 4/2000 | Noser et al. | 173/2 |
| 6,209,659 | B1 | * | 4/2001 | Blessing | 173/201 |

* cited by examiner

*Primary Examiner*—Scott A. Smith
(74) *Attorney, Agent, or Firm*—Sidley Austin Brown & Wood, LLP

(57) ABSTRACT

An electrical hand operated tool driving device (1) for producing an at least partially impacting movement of a tool (11) with an air striking mechanism (2) and a no-load stroke disconnection, which scans the no-load stroke position (9) by a sensor (14) and evaluates it with an assigned control unit (15), and in the event of a no-load stroke, lowers the rpm of an energizing driving mechanism (3) over the control unit (15) to a previously fixed reduced rpm.

7 Claims, 1 Drawing Sheet

ELECTRIC HAND TOOL IMPLEMENT WITH NO-LOAD STROKE DISCONNECTION

BACKGROUND OF THE INVENTION

The invention is directed to an at least partially striking electrical hand operated tool driving device, such as a hammer drill or a chisel hammer, with a no-load stroke disconnection of an air striking mechanism.

For producing the impact, electrical hand operated tool driving devices with air striking mechanisms make use of a back and forth oscillating movement, which is applied by an air spring between an energizing piston, movable in a hollow cylinder relative to the cylinder and sealing it, and a spaced free piston, which can be moved, forming a seal, in the direction of the tool axis and axially strikes the tool over an anvil. Advantageously, in the absence of a counter-pressure, the impact on the tool, which can move axially to a limited extent in a tool seat, is interrupted over a no-load stroke disconnection.

According to EP759341A3, when the anvil assumes a no-load stroke position, made possible by an enlargement of the no-load path, the air spring is vented to the ambient atmosphere or the control valves for the no-load stroke disconnection and, with that, a pressure difference, producing the impact, is prevented. The valves and valve control, required for this, are a disadvantage of such a solution.

For disconnecting the no-load stroke, in accordance with WO88/06508, the driving mechanism of the striking mechanism is interrupted automatically over a coupling, when the tool assumes an axial no-load stroke position, which is measured with a sensor and evaluated by a control unit. The coupling, required for this purpose, is a disadvantage of such a solution.

SUMMARY OF THE INVENTION

It is a primary object of the invention to provide a simple solution for the no-load stroke disconnection of an at least partially striking electrical hand operated tool driving device.

Essentially, the axial position of the tool, the anvil or the striking mechanism is scanned with a sensor and this information is evaluated by a control unit which, in the event of a no-load stroke, lowers the rpm of the energizing driving mechanism to a previously fixed value. Accordingly, the invention holds, according to the law of cause and effect, that the rpm of the energizing driving mechanism, which causes the no-load strokes, remains constant. When the rpm of the energizing driving mechanism has been lowered sufficiently, a pressure difference, accelerating the free piston, is no longer developed due to the venting openings, as a result of which no further impacts on the anvil and the tool are produced. For this purpose, the rpm of the energizing driving mechanism is reduced to about 10 to 50% of the working rpm.

Advantageously, the sensor is an inductive or capacitive sensor, which responds to the axial position of one of the tool, the anvil or the striking mechanism.

Alternatively, the sensor is a Hall sensor, which is assigned to a magnet, and can be moved relative to the sensor and is connected with an actuator, which reads the axial position of the tool, the anvil or the striking mechanism.

Preferably, this actuator is constructed fork-shaped, engaging the anvil axially, and fastened at the outer periphery of the anvil, for example, with a light aluminum ring. The actuator, advantageously consisting of a light, very stiff, fiber-reinforced plastic, has a small magnet, which moves the Hall sensor together with the anvil.

Advantageously, the energizing driving mechanism is constructed as an electric motor, the rpm of which can be reduced electronically over the motor electronics by the control unit.

Further, the energizing driving mechanism and an optimum rotational driving mechanism are provided by a common electric motor over a transmission, as a result of which, in the case of a no-load stroke, the rpm is also decreased by an optional rotational movement.

The various features of novelty which characterize the invention are pointed out with particularity in the claims annexed to and forming a part of this disclosure. For a better understanding of the invention, its operating advantages and specific objects attained by it use, references should be had to the drawings and description matter in which there are illustrated and described preferred embodiments of the invention.

BRIEF DESCRIPTION OF THE DRAWING

The invention is explained in greater detail with respect to an advantageous example as illustrated in.

DETAILED DESCRIPTION OF THE INVENTION

Figure 1:
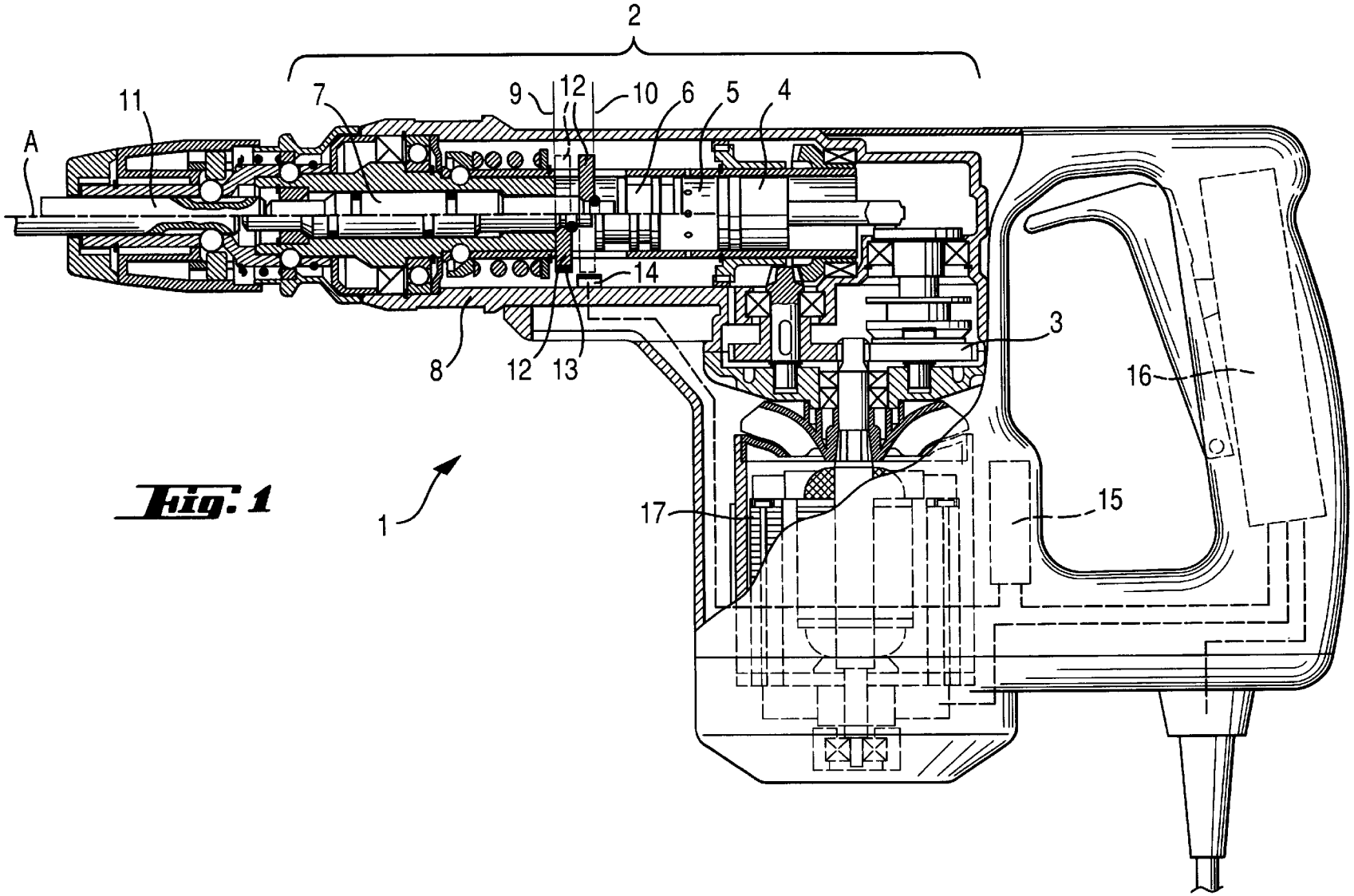
FIG. 1 which is a side view, partly in section, of an electrical hand operated tool driving device with a no-load stroke disconnection.

In FIG. 1, an electrical hand operated tool driving device 1 has an air striking mechanism 2 with an energizing driving mechanism 3, an energizing piston 4, an air spring 5, a free piston 6 and an anvil 7. In FIG. 1*a* part of the tool housing 8 is shown in section and below an impact axis A, the electrical hand operated tool driving device 1 has a no-load stroke position 9 and, in the part of FIG. 1 shown above the impact axis A, it has a working position 10 of a tool 11, shown only in part, of the anvil 7, as well as of the free piston 6. An axially movable actuator 12, including a magnet 13, assigned to a Hall sensor 14, is fastened in the housing 8, and is positively connected with the anvil 7. The Hall sensor 14 is connected electrically with a control unit 15 within the housing 8 and the latter is connected to motor electronics 16 of an electric motor 17.

What is claimed is:

1. An electrical hand operated tool driving device for producing an at least partially impacting movement of an axially elongated tool (11) driven by an air striking mechanism (2) with a no-load stroke disconnection of the impact in the absence of an axial counter-pressure over the tool (11), said air striking mechanism including a driving mechanism (3), having a range of rpm, a piston (4) connected to said driving mechanism (3), a free piston (6) spaced in the axial direction of said tool (11) from said piston (4), an anvil (7) between said free piston (6) and said tool (11), said free piston (6), said anvil (7) and said tool (11) having a no-load stroke position (9) in the event of a no-load stroke, a housing enclosing said no load stroke position (9), a sensor (14) within said housing for scanning said no-load stroke position, a control unit (15) connected to said sensor (14) for evaluating said sensor whereby, in the event of a no-load stroke, the rpm of the driving mechanism can be lowered to a previously fixed rpm by said control unit (15).

2. An electrical hand operated tool driving device as set forth in claim 1, wherein said sensor (14) scans the no-load stroke position (9) of one of said tool (11), said anvil (7) and said free piston (6).

3. An electrical hand operated tool driving device as set forth in claim 1, wherein said sensor (14) is formed of one of an inductive sensor and a capacitive sensor.

4. An electrical hand operated tool driving device as set forth in claim 1, wherein said sensor (14) is a Hall sensor with a magnet (13) movable relative to said sensor.

5. An electrical hand operated tool driving device as set forth in claim 4, wherein said magnet (13) is connected to an axially movable actuator (12) for scanning the no-load stroke position (9) of one of said tool (11), said anvil (7) and said free piston (5).

6. An electrical hand operated tool driving device as set forth in claim 1, wherein an electric motor (17) drives said driving mechanism (3), motor electronics (16) connected to said electric motor (17), and said driving mechanism is controlled by said motor electronics.

7. An electrical hand operated tool driving device as set forth in claim 6, wherein said driving mechanism (3) and a rotating driving mechanism form part of a transmission driven by said electric motor (17).

* * * * *